United States Patent [19]

Tisma

[11] 4,050,648

[45] Sept. 27, 1977

[54] THREAD STORAGE AND DISPENSING SYSTEM

[75] Inventor: Stevan Tisma, Niles, Ill.

[73] Assignee: John O. Butler Company, Chicago, Ill.

[21] Appl. No.: 743,693

[22] Filed: Nov. 22, 1976

[51] Int. Cl.[2] ..... B65H 75/14; B65H 49/00

[52] U.S. Cl. ..... 242/129.8; 225/63; 242/118.4; 242/137.1

[58] Field of Search ..... 242/68.5, 129.8, 137.1, 242/156, 118.3–118.7; 132/92 R, 92 A; 225/46, 47, 51, 52, 63, 64, 79

[56] References Cited

U.S. PATENT DOCUMENTS

| | | | |
|---|---|---|---|
| 2,145,178 | 1/1939 | Hawkins | 225/63 |
| 2,550,944 | 5/1951 | Stack | 242/137.1 |
| 3,106,363 | 10/1963 | Epstein | 242/68.5 |
| 3,270,980 | 9/1966 | Philips | 242/118.7 |
| 3,312,410 | 4/1967 | Strothmann | 242/68.5 |

*Primary Examiner*—Leonard D. Christian
*Attorney, Agent, or Firm*—Laff, Whitesel & Rockman

[57] ABSTRACT

A spool of thread, such as dental floss, is housed in a two-part shell or holder, preferably made of plastic, one of the two parts having a central post coaxially located therein. The thread or floss is wound on a bobbin having a clutch molded in its hub area. The clutch comprises a split cylinder having a generally C-shaped cross section with three equally spaced ribs running along the internal length thereof. The C-shape of the split cylinder embraces the central post and the surfaces of the three ribs provided areas for friction gripping the central post. The friction keeps the bobbin from unwinding; however, the friction is not so great that it keeps the thread or floss from pulling smoothly and evenly from the bobbin.

9 Claims, 5 Drawing Figures

THREAD STORAGE AND DISPENSING SYSTEM

This invention relates to holders for spools of thread and more particularly to clutch mechanisms for such holders, in order to prevent unwanted rotation or unwinding of the spool, while enabling a withdrawal of a predetermined amount of such thread responsive to a predetermined pulling force.

The term "thread" is used herein as a generic term to designate any suitable thread, string, twine, rope or the like. It is presently thought that dental floss is the specific thread that is most likely to be stored in the holder.

Holders of the invention type for spools of thread have many uses, one of which is to hold a relatively large supply of dental floss. The general characteristics of such a holder usually requires an almost instantaneous removal of any selected length of thread, a means for cutting and holding the cut end of thread, and a means for securing the spool to prevent it from rotating or unwinding when the thread is not being remoed therefrom.

In addition, when the thread is dental floss, the entire package should be as small as possible for the length of enclosed thread so that it may be carried about in a pocket or purse, with a minimum of inconvenience. Beyond this, the holder should be attractive, to present a maximum sales appeal. It should also be of a shape and size which is easy for a person to manipulate, even when such person does not have normal dexterity.

Accordingly, an object of the invention is to provide a new and improved holder and packaging system for a spool of thread. Here an object is to provide a holder which can be made almost as small as the maximum sized spool likely to be used in the holder. Further, an object is to give ready access to almost any desired length of the thread, while restraining the spool to prevent an unwanted unwinding.

Another object of the invention is to provide a basic design and form of thread holder which has general utility for virtually any size of spool or thread, and yet meets the specific needs of a dental floss holder. Here, an object is to provide a holder at a minimum cost.

In keeping with an aspect of the invention, these and other objects are accomplished by means of a housing constructed from two generally cylindrical sections which snap together near their peirpheries. One of the housing sections has a central coaxial post located therein. The thread or floss is wound on a bobbin having a clutch molded in its hub area. The clutch comprises a split cylinder having a general C-shaped cross section with three equally spaced, longitudinal ribs running along the internal length thereof. The C-shape of the split cylinder embraces the central post and the surfaces of the three ribs provide areas for friction gripping the central post. The friction keeps the bobbin from unwinding; however, the friction is not so great that it keeps the floss from pulling smoothly and evenly from the bobbin.

The nature of a preferred embodiment of the invention may be understood from the attached drawing, wherein.

Figure 1:
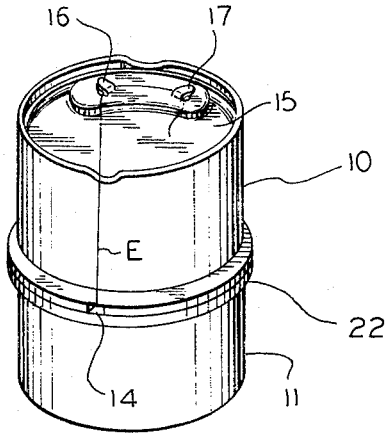
FIG. 1 is a perspective view of the inventive thread holder.
Figure 2:
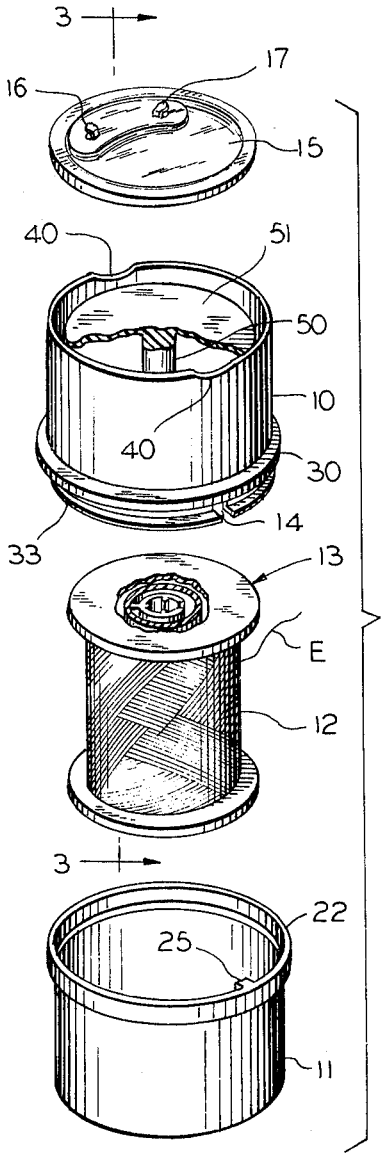
FIG. 2 is a perspective and exploded view of the holder of FIG. 1 and of the spool of thread enclosed therein.
Figure 3:
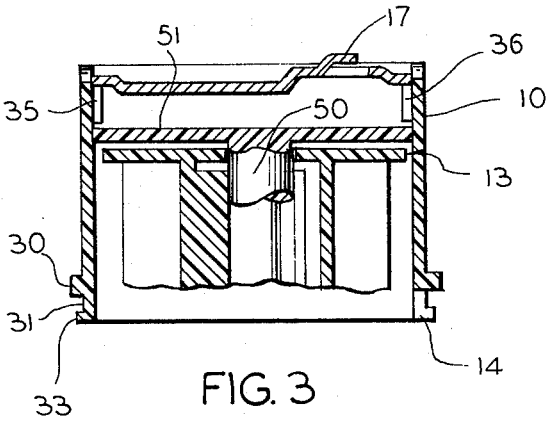
FIG. 3 is a cross-sectional view of the upper housing part taken along line 3—3 of FIG. 2.

One embodiment of the inventive thread holder (FIG. 1). is especially adapated to store and dispense dental floss. The holder comprises upper and lower holder shells or parts 10, 11, each of whih has a generally cylindrical shape. A spool or ball 12 of thread (especially dental floss) is wound on a bobbin 13 for enclosure within the holder, with a loose end E of the thread leaving the holder through hole or opening 14. A top closure plate 15 closes the upper holder part 10 and has at least one semi-pierced detent 16 formed thereon for cutting and anchoring the loose end E of the thread. In this example, there are to such detents 16, 17 on closure plate 15.

The lower holder shell or part 11 comprises a generally cylindrical container having a closed bottom to give a generally thimble shape.

The rim or top of the lower shell part flares outwardly (at 22) and extends cylindrically upwardly. Therefore, an enlarged circumferential space 22 is provided in the upper peripheral edge of lower part 11 for telescopingly receiving the bottom of the upper part 10. The outwardly flared cylindrical section 22 preferably includes a key or embossment 25 which fits into hole 14, for indexing the upper and lower parts 10, 11, when they are snapped together.

The upper part 10 comprises a generally cylindrical member having a diameter which is substantially the same as the diameter of the lower part 11. The lower edge of upper part 10 has a bead 30 which is approximately the same diameter as the flared cylindrical section 22 on the top of the lower part. Dependent below the bead 30 is a neck 31 of reduced diameter and a gripping portion 33 of slightly larger diameter. The gripping portion 33 is an annular bead surrounding the circumference of member 10.

The lower portion 11 has an internal circumferential outwardly projecting bead within the flared cylindrical area 22 which snaps over the gripping portion 33 of the upper part 10. The proportions are such that the dependent sections 31 and 33 slip with friction inside the cylindrical section 22 until bead 30 comes to rest on top of the part 22. When connected, the parts 10 and 11 resist separation, so that it is difficult to separate the holder without prying. To provide greater resistance to separation, parts 10 and 11 may be connected by sonic welding.

The upper interior surface of cylindrical part 10 contains a number of circumferentially spaced embossments, 35, 36 for establishing an upper stop position. Thus, the closure plate 15 may be pressed into the top of upper part 10, to rest on the spaced embossments in a position which is substantially perpendicular to the axis of the housing cylindrical sections.

At one or two points 40 in the upper rim of the part 10, there is a depression or cut out which enables the loose end E of the thread to be brought under a semi-pierced detent 16, 17 and to be cut and anchored.

It should now be apparent that a bobbin of thread (especially dental floss) may be placed insider a holder having internal contours which are almost the same shape as, and only slightly larger than the spool. Thus, there is virtually no wasted spaced or undue amount of bulk, either inside or outside the housing.

Inside the top portion of the upper part 10 is a clutch assembly for preventing any unwanted or random unwinding of the thread on the bobbin 13. In greater detail, the upper cylindrical section 10 has a centrally located post 50 molded therein and secured thereto by means of a bulkhead 51 extending across the entire cross section of the housing. The central post 50 depends into the region of the housing which receives the bobbin 13 of dental floss.

Figure 4:
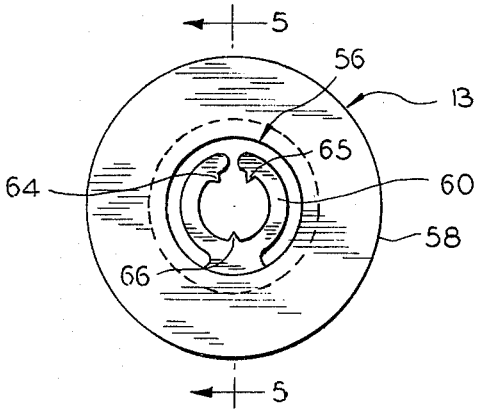
FIG. 4 is a plan view of the bobbin.
Figure 5:
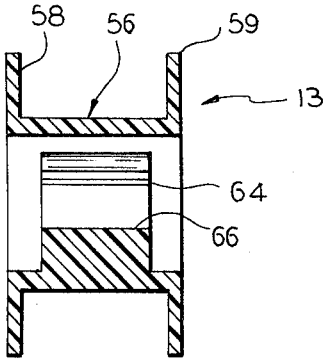
FIG. 5 is a cross-sectional view, taken along line 5—5 of FIG. 4.

The dental floss is wound on bobbin 13 seen in plan view in FIG. 4 and in cross section in FIG. 5. The bobbin 13 comprises a hub region 56 terminated at either end by flanges 58, 59. The interior of hub 56 has a split cylinder 60 having a generally C-shape. In FIG. 4, the C-shape is outlined in heavily inked lines, for easy identification. Running down the length of split cylinder 60 are three longitudinal ribs 64, 65, 66, equally spaced around the internal circumference of the C-shape.

When the bobbin 13 is placed over the center post 50, the C-shaped cross section embraces the post, and the friction between the bobbin and post is distributed over the rubbing surfaces of three ribs 64, 64, 66. The resulting frictional forces are sufficient to prevent the floss on the bobbin 13 from unwinding at random, but not so great that it cannot be pulled smoothly and evenly from the bobbin.

Those who are skilled in the art will readily perceive how changes and modifications may be made in the inventive structure. Therefore, the appended claims are to be construed broadly enough to cover all equivalent structures falling within the scope and the spirit of the invention.

I claim:

1. A thread holder comprising a two part shell, one of part of the holder shell including an integral central post coaxially located therein to enable a rotation of a bobbin mounted on said post, bobbin means having a hub region containing a split cylinder with a C-shaped cross section, said cross section embracing said central post, and means in said cross section for contacting and dragging with predetermined friction against the central post, the friction being great enough to prevent an unwanted and random unwinding of the thread from said bobbin and yet small enough to preclude any substantial opposition to a desired withdrawal of thread.

2. The holder of claim 1 wherein said C-shaped cross section includes a plurality of longitudinally extending ribs for gripping said central post.

3. The holder of claim 2 wherein each of said holder parts comprises a generally cylindrical container, said containers snapping together at their open ends, and said post depends from a closed end of one of said parts.

4. The holder of claim 3 wherein the rim of one part flares outwardly to form a cylindrical section and the rim of the other part telescopingly fits into said cylindrical section, and an opening formed in the rim of at least one of said parts to enable the thread to pass out of said holder at a point where said sections fit together.

5. The holder of claim 2 wherein there are three of said longitudinal ribs spaced at equidistances around said C-shaped cross section.

6. An article comprising bobbin means; a post for supporting said bobbin means so that said bobbin means can rotate about said post, said bobbin means having a hub; a split cylinder mounted within the hub of the bobbin means and running parallel to the axis of said hub, said split cylinder fitting over, contacting, and dragging against the post with predetermined friction, which is great enough to prevent an unwanted and random unwinding of said bobbin and yet small enough to preclude any substantial opposition to a desired withdrawal of thread.

7. The article of claim 6 wherein said post is enclosed within a holder and said post depends co-axially from one end of said holder.

8. The article of claim 6 wherein said split cylinder internally includes a plurality of longitudinally extending ribs for gripping said central post.

9. The article of claim 8 wherein there are three of said longitudinal ribs spaced equidistantly around the internal cross section of said split cylinder.

* * * * *

UNITED STATES PATENT AND TRADEMARK OFFICE

CERTIFICATE OF CORRECTION

PATENT NO. : 4,050,648

DATED : September 27, 1977

INVENTOR(S) : Stevan Tisma

It is certified that error appears in the above–identified patent and that said Letters Patent are hereby corrected as shown below:

In the abstract, line 10, "provided" should be --provide--

Column 1, line 14, "invention" should be --inventive--

Column 1, line 22, "remoed" should be --removed--

Column 1, line 48, "peirpheries" should be --peripheries--

Column 1, line 52, "general" should be --generally--

Column 2, line 7, "adapated" should be --adapted--

Column 2, line 9, "whih" should be --which--

Column 2, line 64, "insider" should be --inside--

Column 2, line 67, "spaced" should be --space--

Column 3, line 23, "ribs, 64, 64, 66" should be -- ribs 64, 65, 66 --.

Column 3, claim 1, line 35, "of" at the end of the line should be omitted.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*